US005496195A

United States Patent [19]

Reed

[11] Patent Number: 5,496,195

[45] Date of Patent: Mar. 5, 1996

[54] HIGH PERFORMANCE SHIELDED CONNECTOR

[75] Inventor: Carl G. Reed, Clemmons, N.C.

[73] Assignee: The Whitaker Corporation, Wilmington, Del.

[21] Appl. No.: 403,028

[22] Filed: Mar. 13, 1995

[51] Int. Cl.[6] ..... H01R 13/648

[52] U.S. Cl. ..... 439/607; 439/609

[58] Field of Search ..... 439/607, 608, 439/609, 101, 108, 540, 676, 939

[56] References Cited

U.S. PATENT DOCUMENTS

| | | | |
|---|---|---|---|
| 4,659,163 | 4/1987 | Althouse et al. | 439/608 |
| 5,045,977 | 9/1991 | Cesar | 439/607 X |
| 5,207,597 | 5/1993 | Kline et al. | 439/607 |
| 5,378,172 | 1/1995 | Roberts | 439/607 |
| 5,387,130 | 2/1995 | Fedder et al. | 439/607 X |

*Primary Examiner*—Khiem Nguyen

*Attorney, Agent, or Firm*—William B. Noll

[57] ABSTRACT

Invention is directed to a high performance, shielded electrical connector which exceeds EIA/TIA 568-A requirements for Category 5 applications. A preferred connector is a modular jack, such as an array of modular jacks mounted to a printed circuit board, grounded within a metal housing. The connector comprises a dielectric housing having a top surface, a printed circuit board engaging surface, a pair of side walls, and a front surface, and at least one cavity extending interiorly from the front surface thereof for electrically engaging a complementary electrical connector. The connector includes a one-piece shielding member, stamped and formed from a sheet metal blank, to offer low resistance grounding of the connector. The shielding member is adapted to lie contiguous with at least the top surface and the side walls, and includes a plurality of cantilevered tabs struck from the walls of the metal shielding member. The tabs are elongated and extend from an internal location toward the front surface. Finally, the tabs are further characterized by a free end having a reverse bend therein which, in a resiled position, extends above the plane of the respective walls of the formed shielding member.

8 Claims, 9 Drawing Sheets

10
12
14
15
15
16
18
20
20
22
22
23
23
24
26
30
65
65
65

30
65
12
65
63
30
62
30
64
30
65
65

HIGH PERFORMANCE SHIELDED CONNECTOR

BACKGROUND OF THE INVENTION

This invention is directed to a high performance shielded electrical connector, such as a printed circuit board mounted modular jack, preferably an array of aligned jacks in a metal shielded housing, where such connector exceeds EIA/TIA 568-A requirements for Category 5 applications.

Shielded modular jacks have been used for the transmission of data in local area networks, such as a computer hub. The shielding of these jacks reduces the transmission of noise and sensitivity to external noise, thereby allowing a higher data transmission speed than conventional non-shielded modular jacks. The modular jack is compact and of relatively low cost in comparison to many other data connectors for transmission of high speed data. Accordingly, it is advantageous to use modular jacks in replacement of such connectors. Due to the ever increasing data transmission speeds, and the close spacing of juxtaposed conductors positioned in the modular jack, excessive crosstalk limits the data transmission speed capability of existing modular jacks.

Efforts have been made to improve the performance of modular jacks, through rearrangement of the wires within the jack. However, little has been done to improve the shield thereabout. Typically, as more clearly illustrated in FIGS. 1 and 2, a modular jack is mounted within a metal chassis, generally from the rear, where grounding means extend from the metal connector shield in grounding contact with the metal chassis housing. This will become clearer later in the description to follow. Suffice to say however, there have been problems associated with these prior art techniques in providing an effective low resistance grounding of the system. Typically, such prior art techniques included angularly extending, rearwardly directed tabs struck from the metal shield. One problem, for example, when the assembled jack was pushed completely into the metal chassis opening, the tabs would become hooked or jammed making it difficult to remove the assembly. Further, the tabs could become easily overstressed and/or break resulting in poor or no contact with the metal housing. Finally, such prior art tabs caused handling problems.

The present invention, by the use of a uniquely shaped, reversely oriented grounding tab, overcomes the many problems associated with the prior art techniques. The advantages of this invention, and the manner by which such problems have been overcome, will become apparent in the following specification, particularly when read in conjunction with the accompanying drawings.

SUMMARY OF THE INVENTION

This invention is directed to a shielded, high performance electrical connector of the type for mounting to a printed circuit board, preferably an array of modular jacks, where said jacks are to be grounded to and mounted within a metal panel. The connector comprises a dielectric housing having a top surface, a printed circuit board engaging surface, a pair of side walls, a rear wall and a front surface, and at least one cavity extending interiorly from the front surface thereof for electrically engaging a complementary electrical connector. The connector includes a one-piece shielding member, stamped and formed from a sheet metal blank, to offer low resistance grounding of the connector. The shielding member is adapted to lie contiguous with at lease said top surface, said side walls and said rear wall. A critical feature thereof is the provision of a plurality of cantilevered tabs struck from said metal shielding member, where said tabs are elongated and extend from an internal location toward said front surface. The tabs are further characterized by a free end having a reverse bend therein which in a resiled position extends above the plane of said formed shielding member. By this arrangement, many of the prior art problems of stubbing or poor grounding contact to the metal panel are avoided.

DETAILED DESCRIPTION OF PREFERRED EMBODIMENT

The present invention relates to an improved, high performance, shielded electrical connector. While the invention has broad application in the shielding of a variety of connectors, such as a data connector, it has particular application for shielded modular jacks, especially plural modular jacks arrayed in one or a pair of rows. Accordingly, for convenience and understanding, the further description will be directed to the shielding of modular jacks. However, no undue limitation should be read thereon except as set forth in the appended claims.

Figure 1:
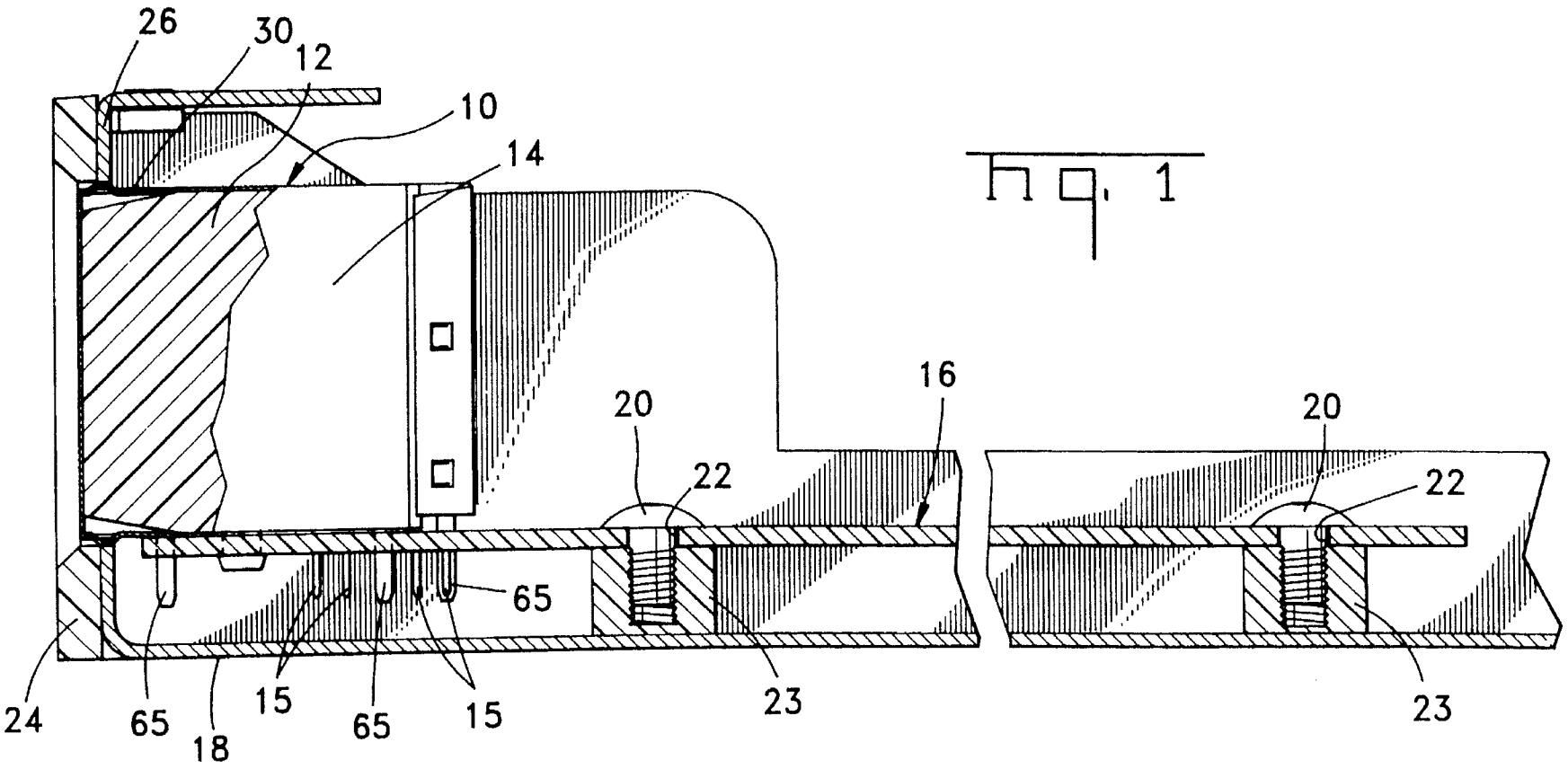
FIG. 1 is a partial, cross-sectional view of a panel mounted, shielded electrical connector, such as a high performance modular jack, in accordance with this invention, where the connector is mounted to a printed circuit board within a metal housing.
Figure 2:
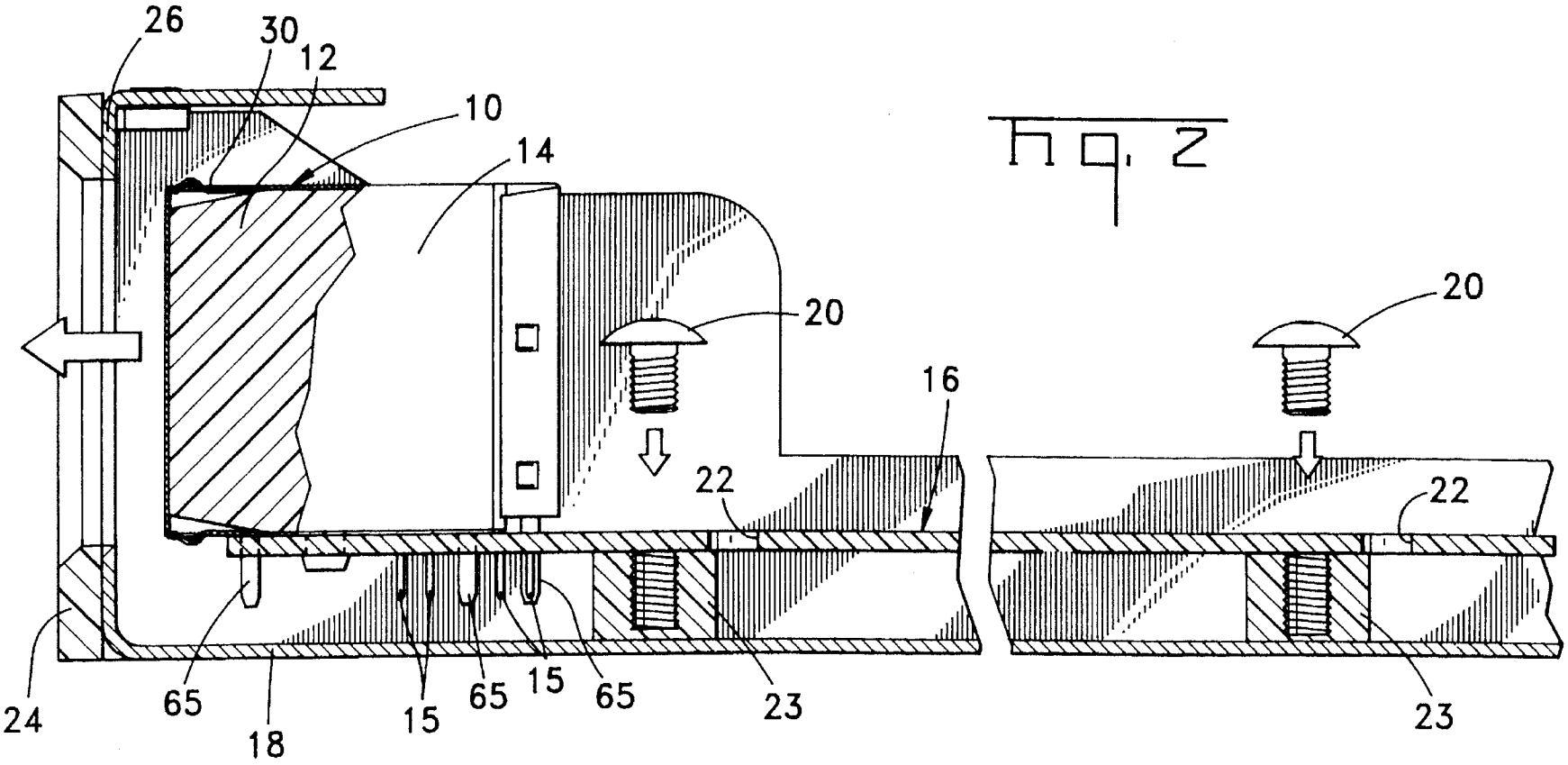
FIG. 2 is a sectional view similar to FIG. 1 but showing a presecuring position of the printed circuit board mounted electrical connector, prior to full engagement of the connector shielding member to the metal housing.

FIGS. 1 and 2 illustrate the shielded electrical connector of this invention in a panel mounted, and prepanel mounted environment, respectively. The electrical connector 10, in the environment of being panel mounted, comprises a dielectric housing 12 and a stamped and formed metal shielding member 14, part of which has been broken away in the respective FIGURES. The connector 10 includes plural signal pins 15 for solder mounting to a printed circuit board (PCB) 16, which typically is loaded from the rear of the panel (note the direction arrow in FIG. 2), then secured to the chassis 18, such as by threaded fastening members 20, via board holes 22 into standoffs 23. The panel chassis 18 may consist of a dielectric panel 24 having a metal shielding liner 26 to which grounding of the connector 10 is made. Though more details will be offered later, it will be noted in FIG. 1 that the connector grounding tab 30, when the shielded connector is fully mounted therewithin, is in grounding contact with the metal liner 26. The grounding contact is more clearly illustrated in the enlarged sectional views of FIGS. 3 and 4.

Figure 5:
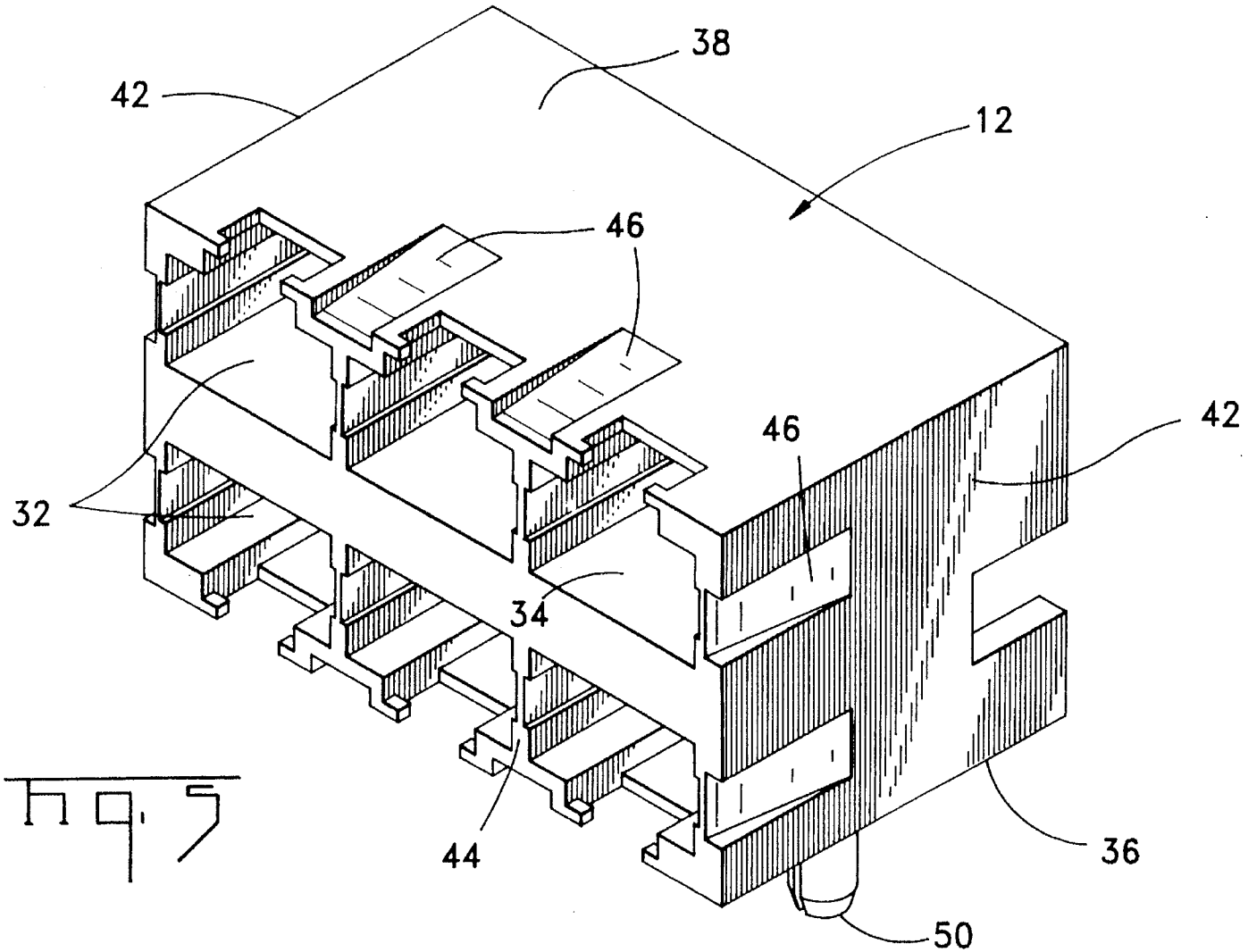
FIG. 5 is a perspective view of an exemplary 6-port electrical connector receptacle that is received within the formed shielding member of FIG. 6.
Figure 6:
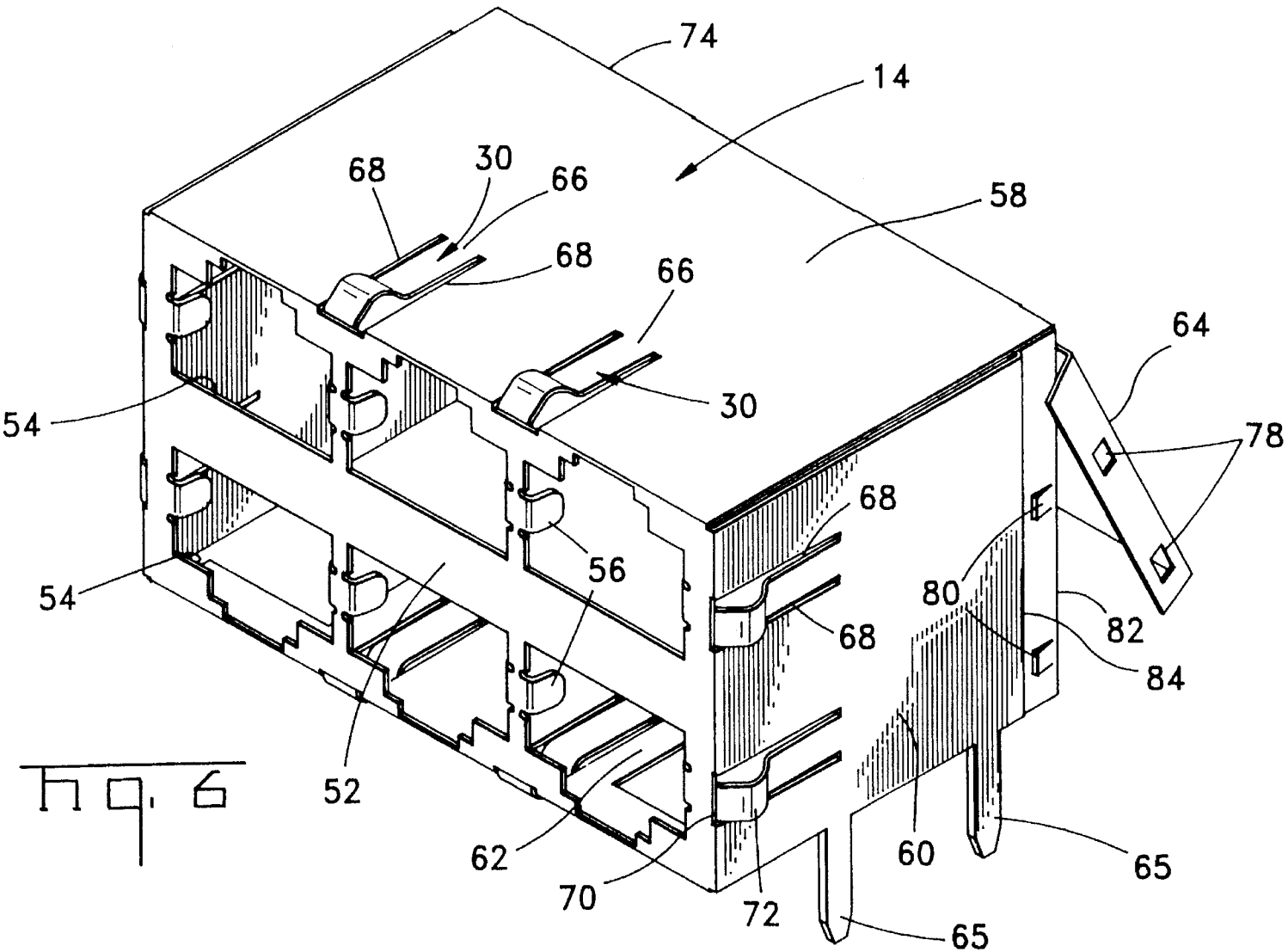
FIG. 6 is a perspective view of a 6-port ground shielding member.
Figure 7:
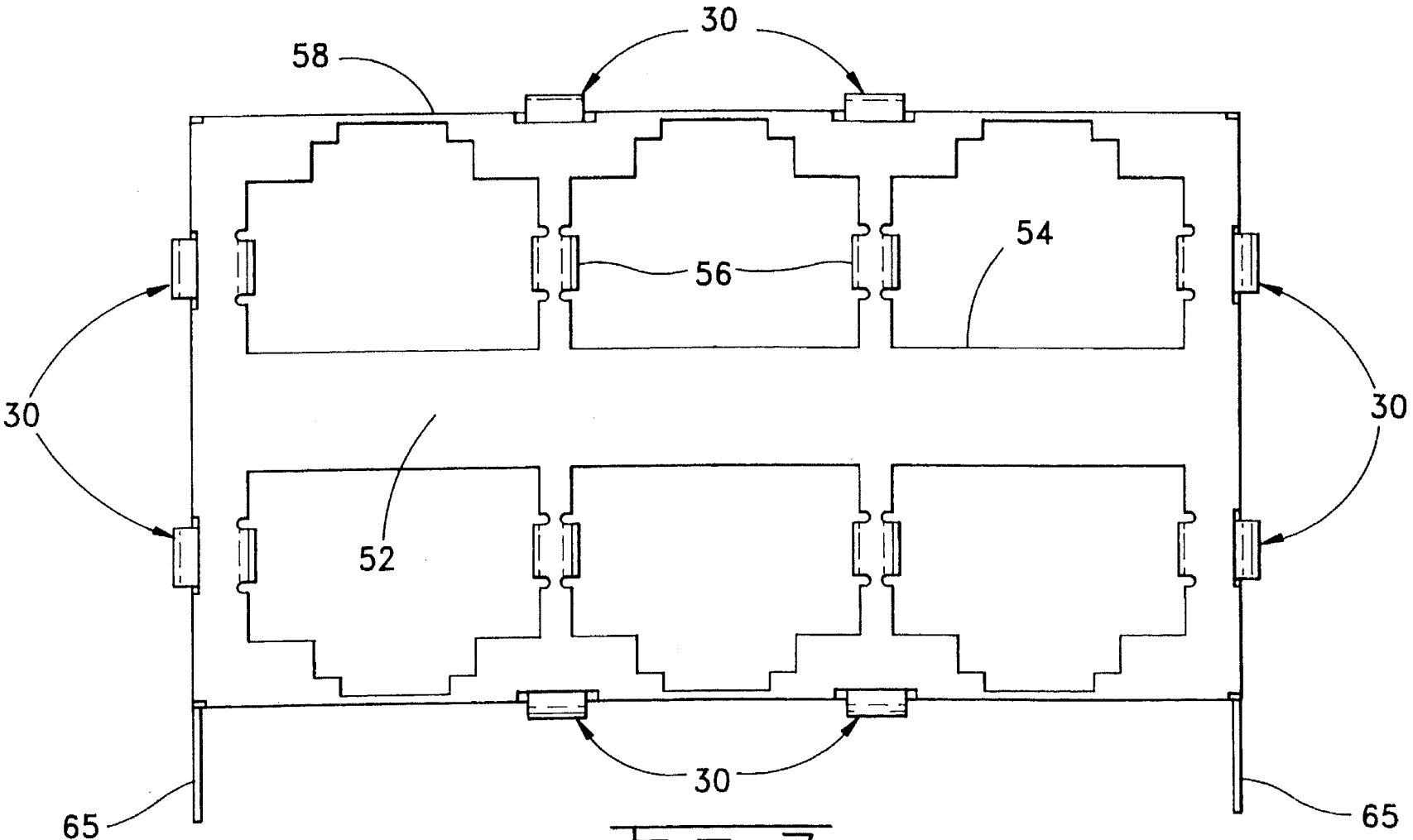
FIG. 7 is a front view of the 6-position ground shielding member of FIG. 6.
Figure 8:
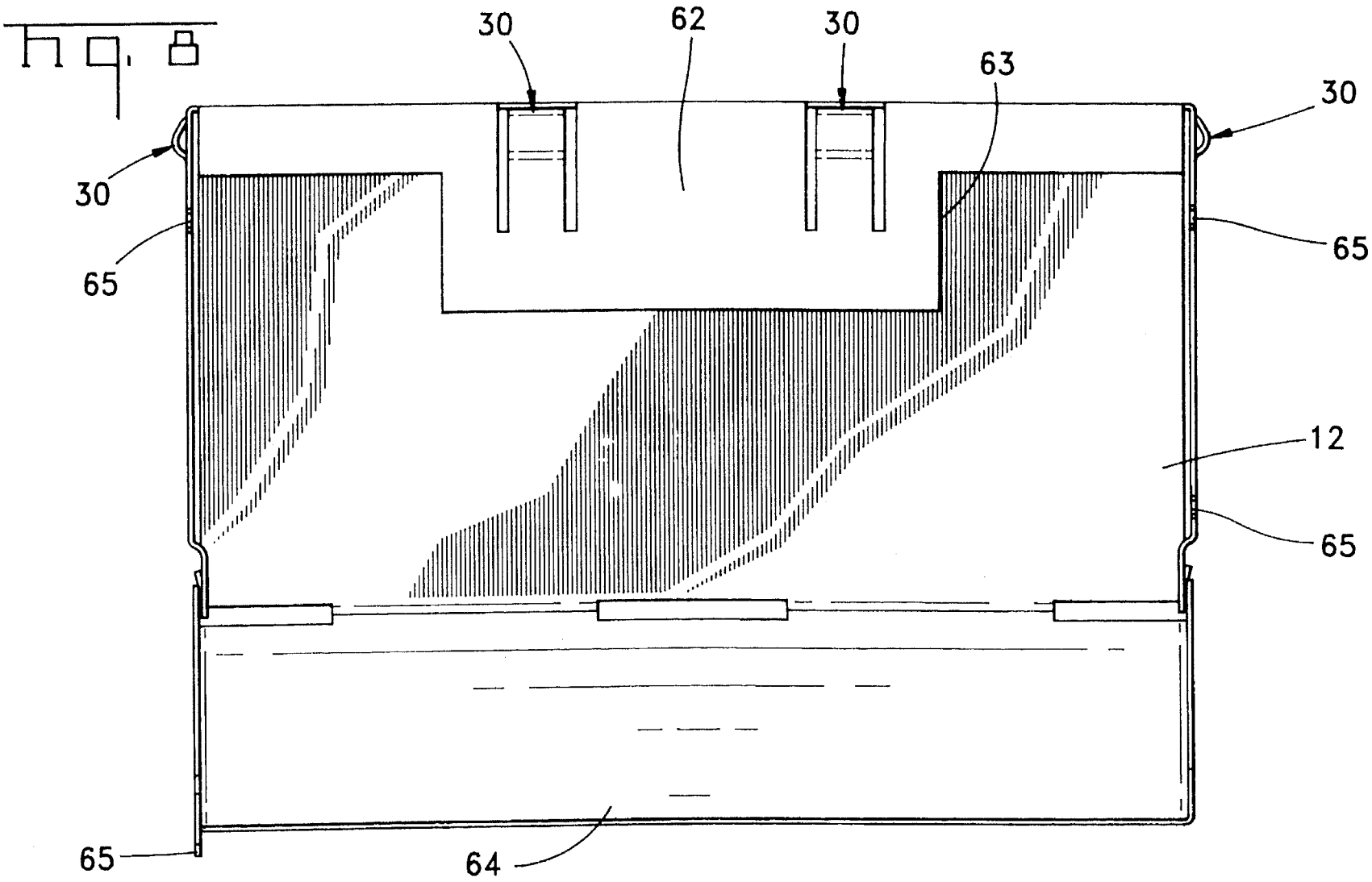
FIG. 8 is a bottom view of the assembled connector/shielding member according to this invention.

However, before examining the connector grounding tab 30 in greater detail, it may be helpful to generally review the dielectric connector housing 12 and stamped and formed metal shielding member 14 of FIGS. 5 and 6, 8, respectively. Considering first the connector housing 12, it typically is molded from a plastic compound, such as a high temperature polyester, and comprises one or more cavities 32 for electrically engaging complementary modular plugs, as known in the art. The cavities 32, for a multi port connector, are typically arranged in side-by-side fashion in two rows separated by a dielectric wall 34. Structurally, the connector housing 12 comprises a board engaging lower surface 36, a top surface 38, a pair of side walls 42, and a front or mating face 44. A unique feature of the housing 12 is the provision of the plural recesses 46, angled forwardly from the interior of top surface 38, lower surface 36, and side walls 42, toward the front or mating face 44. With regard to the recesses 46 along the top and bottom, it will be noted that such recesses are preferably arranged between adjacent cavities 32. Finally, the housing 12 includes a pair of board mounting posts 50, as known in the art.

The metal shielding member 14 is a one-piece metal shell stamped and formed from a sheet metal blank. The shell, illustrated in the formed condition in FIG. 6, includes a front face 52, having connector receiving openings 54, corresponding in number and arrangement to the cavities 32 of the housing 12. Each such opening 54 is provided with a pair of tabs 56 which are arranged to be bent inwardly toward the cavity walls. The shield member 14 further includes a top wall 58, a pair of side walls 60, a partial bottom wall 62 (see FIG. 8) and a pivotal or hinged rear wall 64. While the top, sides and rear walls fully cover or shield the connector housing 12, the lower or bottom wall 62 covers only the forward portion of the housing. It will be recalled, particularly from FIGS. 1 and 2, that solder posts or pins 15 extend from the connector 10, although not shown in FIG. 8, for engagement with complementary through holes in the PCB 16, as known in the art. Additionally, the bottom wall 62 includes a pair of side recesses or cut-outs 63 to accommodate the mounting posts 50. Finally, extending from the lower edge of side walls 60 are solder tabs 65 for grounding to appropriate grounding traces in the PCB 16. Though the manner of forming the shield member 14 is not illustrated by initially depicting a flat blank, it will be understood from the above description and drawings that the front face 52 is essentially the center of the flat blank, with the respective side walls 60, top wall 58 and bottom wall 62 formed therefrom. The rear wall 64, most clearly illustrated in FIG. 9, is bent and formed along the rear edge 74 of top wall 58.

A characteristic feature of the top wall, side walls, and bottom wall, is the provision of plural, cantilevered ground tabs 30, where such tabs extend from an interior position 66 toward the front face 52, between parallel slots 68. The tabs 30, as more clearly illustrated in FIGS. 3 and 4, at the free end 70 thereof, include a reversely formed end 72. By this arrangement, stubbing of the end 70 is prevented during loading of the connector into the opening of panel 26. Additionally, breakage or overstressing is avoided upon removal of the connector therefrom. Overstressing is further avoided by the provision of a long moment arm, i.e. from the interior position 66 to the front face 52. Finally, grounding contact with the metal panel 26 is assured by the fact that the tab formed end 72 extends above the plane of the respective walls, i.e. top wall 58, side walls 60, lower wall 62, in the resiled or relaxed position illustrated in FIG. 3. As best seen in FIG. 4, when the connector is loaded into the opening panel of 26 the tabs 30 are flexed inwardly toward their respective recesses 46, with the reversely formed end 72 in grounding contact with the metal panel 26.

To function as an effective shield, the shielding member 14 must encompass and lie contiguous with the underlying connector housing 12. The rear wall 64 is hingedly mounted from the rear edge 74 of top wall 58 to allow access into the formed shielding member 14, note the loading sequence of FIGS. 9 and 10. After loading, the rear wall 64 is closed in latching engagement with the rear of the side walls 60. This may be accomplished by providing a flanged portion 76 along the side edges of the rear wall, where the flanged portion 76 may include a pair of windows 78, and complementary lances 80 along the rear edges 82 of the side walls 60. The rear portion of the side walls 60 may include a stepped portion 84, which includes the lances 80, so that when the rear wall 64 is hingedly moved into latching engagement with the side walls 60, the sides of the assembly will be flush, that is, the flanged portions 76 will seat within the stepped portions 84.

Figure 9:
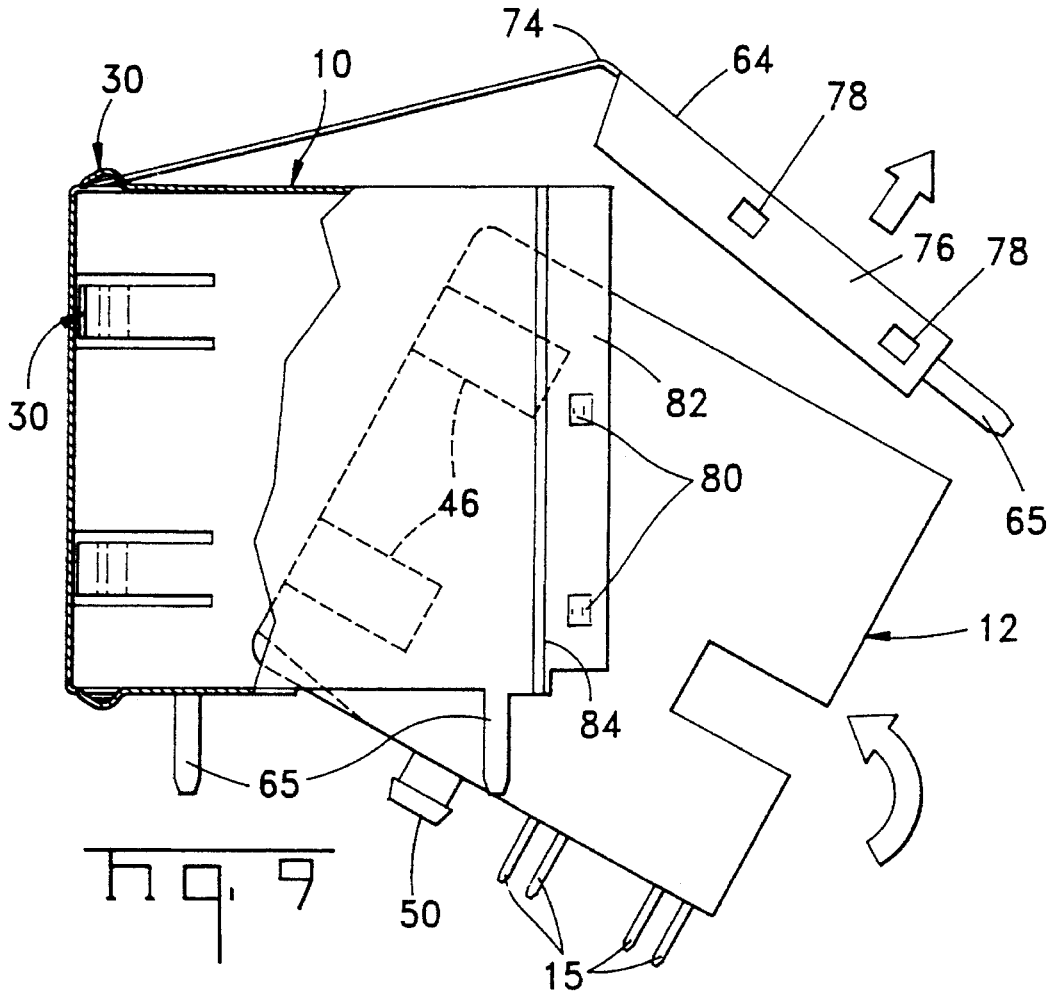
FIGS. 9 and 10, respectively, are enlarged, partially sectioned, side views illustrating the assembly sequence of the shielding member to the connector, prior to being mounted on the printed circuit board and secured within the metal housing.
Figure 10:
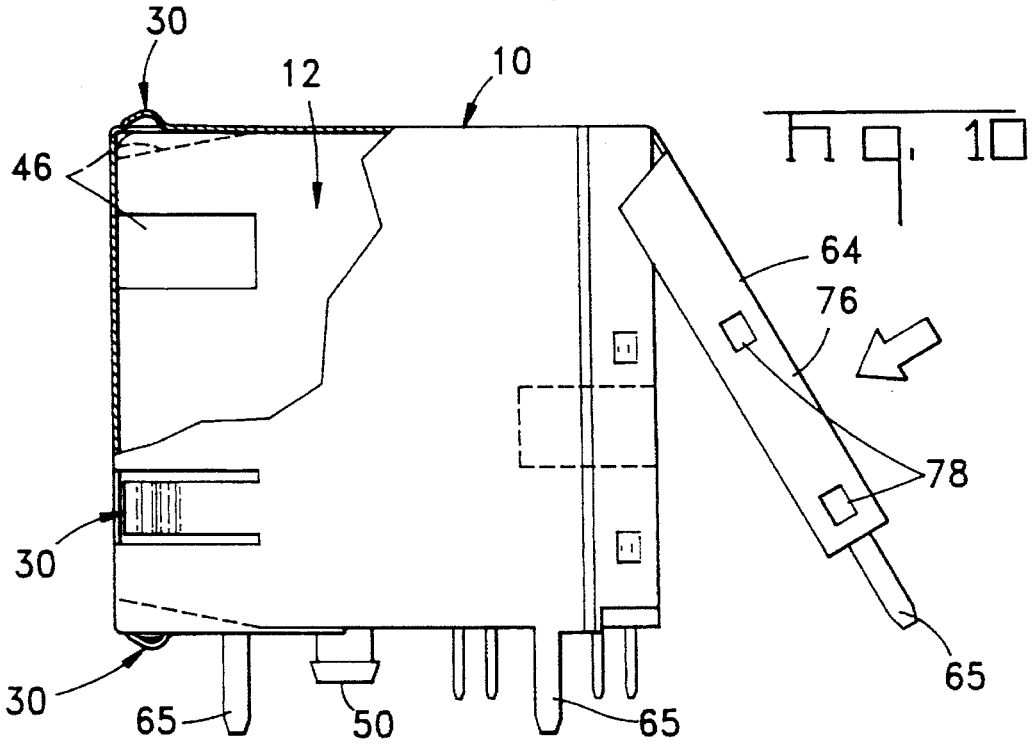

The rear loading sequence is illustrated in FIGS. 9 and 10. After forming of the ground shield member 14 in the manner described above, the hinged rear wall 64 and the top wall 58 remain raised in the manner shown in FIG. 9. In this position, the connector housing 12 is inserted within the formed shield, note the direction arrow, and as shown in FIG. 10, the rear wall 64 is pivoted into contact with the respective side walls 60, while the top wall 58 comes into contact with the top surface 38 of the connector housing 12. As the rear wall 64 engages said walls 60, the lances 80 snap into windows 78 to thereby secure the shield into position.

Figure 3:
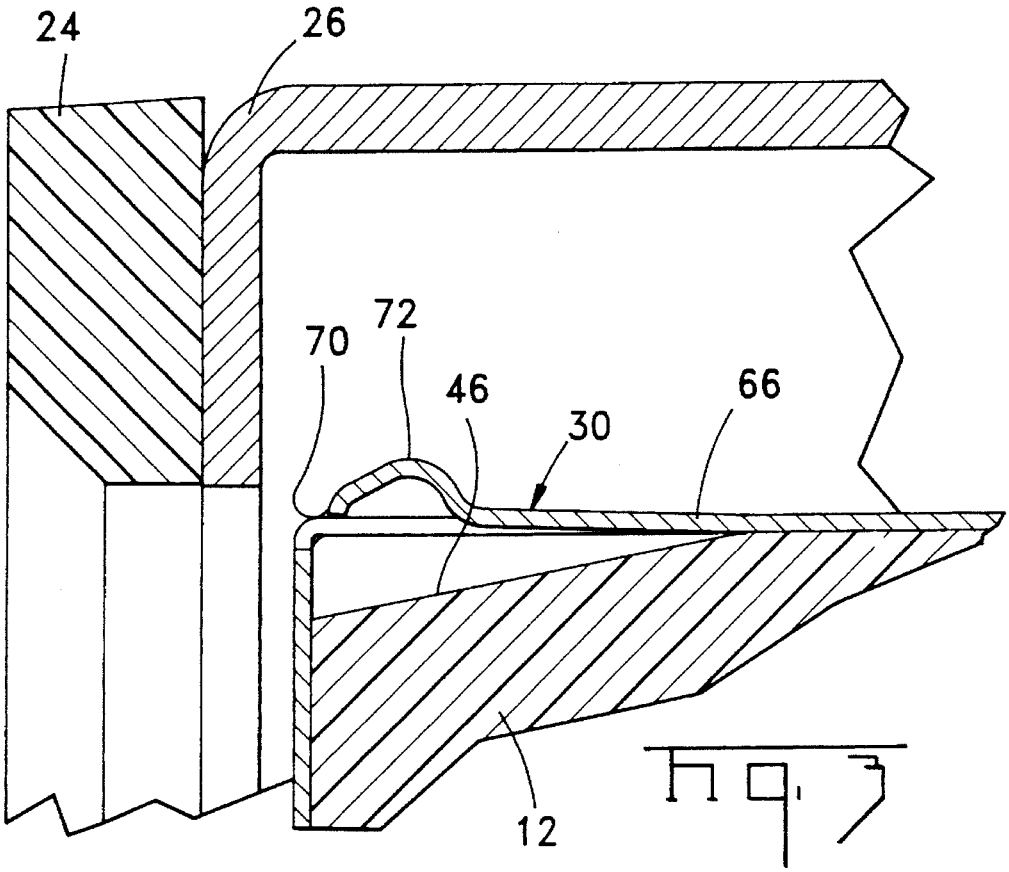
FIGS. 3 and 4, respectively, are enlarged, partial sectional views showing the cantilevered grounding tabs of the connector shielding member prior to and in contact with the metal housing.
Figure 4:
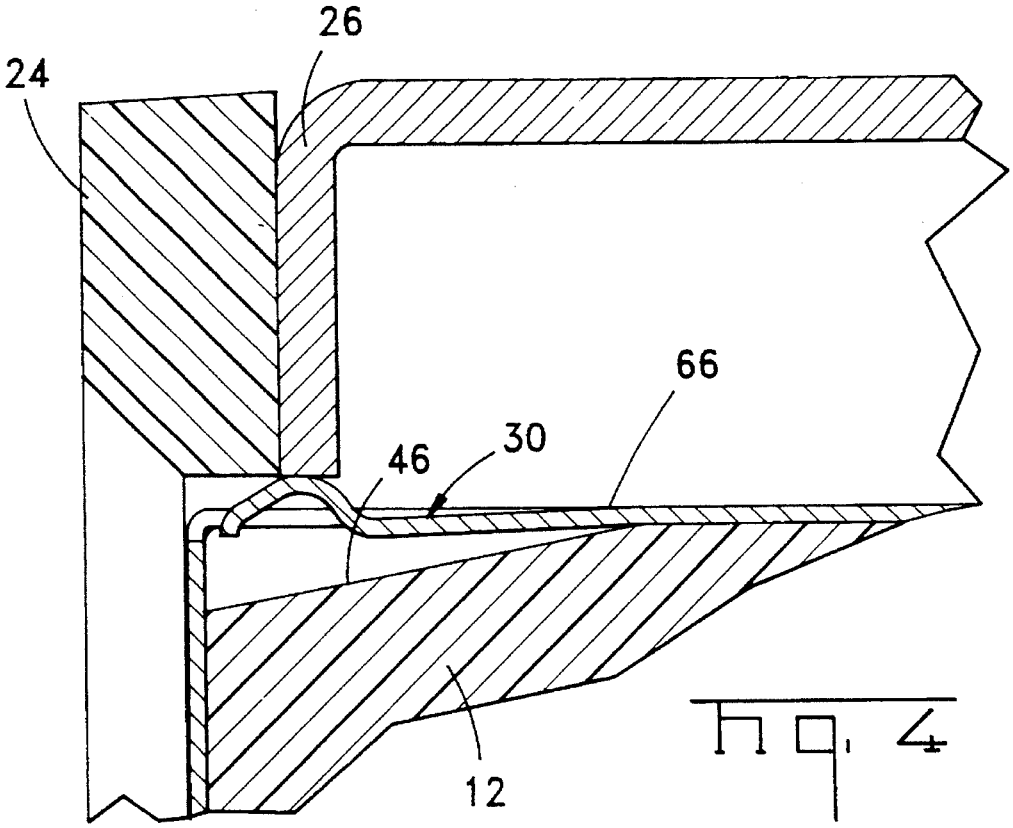
Figure 11:
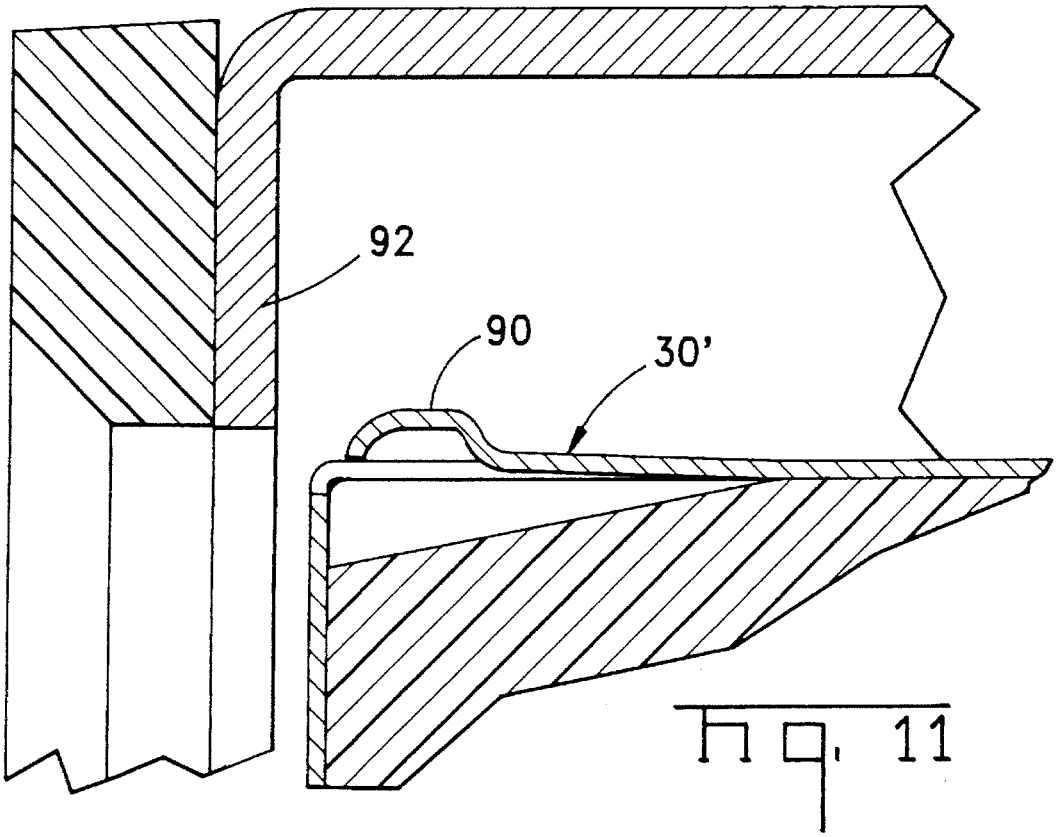
FIGS. 11 and 12 are partial sectional views, similar to FIGS. 3 and 4, illustrating an alternate shape for the grounding tab according to this invention.
Figure 12:
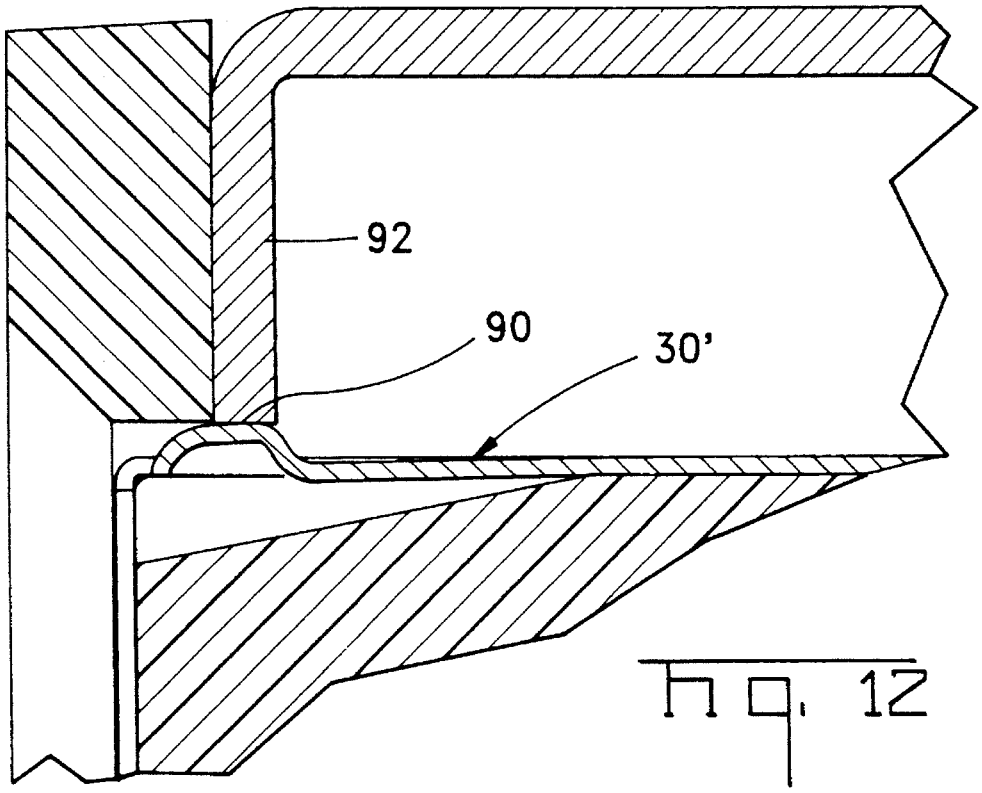

FIGS. 11 and 12, sectional views similar to FIGS. 3 and 4, respectively, illustrate an alternate shape to the cantilevered ground tabs 30'. In this embodiment, the peak or reverse bend portion 90 has been flattened to provide grounding contact over a broader surface. This may be particularly beneficial to ensure registration with the metal panel 92, which may vary in thickness from one application to another.

I claim:

1. A shielded high performance electrical connector of the type for mounting to a printed circuit board and adapted to be secured within a metal panel housing, where said connector comprises a dielectric housing having a planar top surface, a printed circuit board engaging surface, a pair of side walls, a rear wall and a front surface, and at least one cavity extending interiorly from the front surface thereof for electrically engaging a complementary electrical connector, said connector including a one-piece shielding member stamped and formed from a sheet metal blank to offer low resistance grounding of the connector to said metal panel housing, said shielding member adapted to lie contiguous with at least said top surface, said side walls and said rear wall, and a plurality of elongated cantilevered tabs struck from said metal shielding member, said tabs having a secured end and a free end, where said secured end extends from an internal location remote from said front surface, and said free end extends toward said front surface; said tabs further characterized by said free end having a reverse bend therein which in a resiled position extends above the plane of said shielding member contiguous with said planar top surface.

2. The shielded electrical connector according to claim 1, wherein said shielding member includes a shielding face which overlies said front surface, and that said shielding face includes a complementary opening aligned with a respective said cavity.

3. The shielded electrical connector according to claim 1, wherein a first portion of the shielding member overlying said rear wall is hingedly secured to a second portion of the shielding member overlying said top surface, and that said first portion includes a flanged portion to engage that portion of the shielding member which overlies said side wall.

4. The shielded electrical connector according to claim 1, wherein said dielectric housing includes a recess extending from said front surface in registration with each said tab to allow inward deflection of said tab when secured within a metal panel housing.

5. The shielded electrical connector according to claim 4, wherein said dielectric housing comprises an array of cavities in a side-by-side relationship, and that said tabs along the top surface and board engaging surface are aligned between adjacent said cavities.

6. The shielded electrical connector according to claim 2, wherein there are two rows of plural cavities.

7. The shielded electrical connector according to claim 4, wherein the end most portion of each said free end is directed toward its respective said recess.

8. The shielded electrical connector according to claim 1, wherein each said tab is defined by a pair of parallel slots extending inwardly from said front surface.

* * * * *